United States Patent [19]

Myochin et al.

[11] Patent Number: 4,574,326

[45] Date of Patent: Mar. 4, 1986

[54] ELECTRICAL CHARGING APPARATUS FOR ELECTROPHOTOGRAPHY

[75] Inventors: Hisashi Myochin, Toyohashi; Kuniki Seino, Aichi, both of Japan

[73] Assignee: Minolta Camera Kabushiki Kaisha, Osaka, Japan

[21] Appl. No.: 708,945

[22] Filed: Mar. 6, 1985

[30] Foreign Application Priority Data

Mar. 9, 1984 [JP] Japan ..... 59-34727[U]

[51] Int. Cl.[4] ..... H05F 3/06

[52] U.S. Cl. ..... 361/229; 361/213; 361/220; 422/186.04; 250/324; 250/326

[58] Field of Search ..... 422/186.04; 250/324, 250/326; 361/229, 220, 213

[56] References Cited

U.S. PATENT DOCUMENTS 3,843,906 10/1974 Leibrecht ..... 250/324
4,454,559 6/1984 Shency ..... 361/229
4,456,365 6/1984 Yuasa ..... 250/326

FOREIGN PATENT DOCUMENTS 2134698 1/1973 Fed. Rep. of Germany ..... 361/229

*Primary Examiner*—John F. Terapane
*Assistant Examiner*—Susan Wolffe
*Attorney, Agent, or Firm*—Watson, Cole, Grindle & Watson

[57] ABSTRACT

An electrical charging apparatus which includes a confronting electrode formed by a metallic plate, a heat-resistant electrically insulative member for covering a surface of the confronting electrode, an exciting electrode in the form of a thin wire fixed to a surface of the heat-resistant electrically insulative member so as to face the confronting electrode through the heat-resistant electrically insulative member, a power source for applying a high voltage AC current between the confronting electrode and the exciting electrode, and a control electrode in the form of a mesh provided to confront the exciting electrode.

7 Claims, 8 Drawing Figures

ELECTRICAL CHARGING APPARATUS FOR ELECTROPHOTOGRAPHY

BACKGROUND OF THE INVENTION

The present invention generally relates to an electrical charging arrangement and more particularly, to an electrical charging apparatus for imparting electrical charge through a surface creepage or creeping discharge.

Generally, in an electrical charging apparatus arranged to impart electrical charge through corona discharge, a large amount of ozone is produced thereby during its electrical discharging, and it is known that ozone as referred to above not only deteriorates a photosensitive member or photoreceptor of an electrophotographic copying apparatus and the like, but also is harmful to human bodies. In order to overcome the disadvantages as described above, there have conventionally been proposed, for example, in Japanese Patent Laid-Open Publication Tokkaisho No. 56-154759, electrical charging devices (or corona discharging devices) as shown in FIGS. 1 through 4 in which a plurality of heating members 5, 6, 6' and 8 are respectively provided in the vicinity of corona electrodes 1 for thermal decomposition of ozone produced near the corona electrodes 1.

However, in the known devices as described above, since heating temperatures of the heating members 5, 6, 6' and 8 are set in the range of 200° to 300° C., the corona electrodes 1 tend to be expanded by the heat, thus resulting in non-uniformity of discharging characteristics. Meanwhile, when the electrical charging devices as described above are employed for an electrophotographic copying apparatus, there are such disadvantages that deterioration of a photosensitive member or photoreceptor and fusion of toner, etc. take place by the heat radiated by the heating members 5, 6, 6' and 8, with a further increase of power consumption.

For solving the various problems as referred to above, it may be considered to suppress the heat values of the heating members 5, 6, 6' and 8. However, when the heating temperatures thereof are lowered, although part of ozone may be subjected to thermal decomposition by the heating members 5, 6, 6' and 8, some other part of ozone passes between the respective heating members without being decomposed, thus resulting in a low ozone decomposing efficiency.

SUMMARY OF THE INVENTION

Accordingly, an essential object of the present invention is to provide an improved electrical charging apparatus which is capable of efficiently decomposing generated ozone, without giving rise to deterioration of a photoreceptor, fusion of toner, increase of power consumption, etc.

Another important object of the present invention is to provide an electrical charging apparatus of the above described type which is simple in construction and stable in operation, and can be readily incorporated into an electrophotographic copying apparatus and the like at low cost.

In accomplishing these and other objects, according to one preferred embodiment of the present invention, there is provided an electrical charging apparatus which includes a confronting electrode formed by a metallic plate, a heat-resistant electrically insulative member for covering a surface of the confronting electrode, an exciting electrode in the form of a thin wire fixed to a surface of the heat-resistant electrically insulative member so as to face the confronting electrode through the heat-resistant electrically insulative member, a power source for applying a high voltage AC current between the confronting electrode and the exciting electrode, and a control electrode in the form of a mesh provided to confront the exciting electrode.

By the arrangement according to the present invention as described above, an improved electrical charging apparatus has been presented through simple construction.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
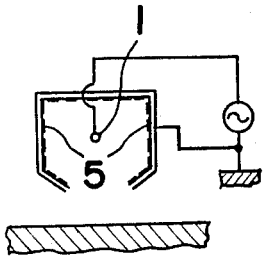
Fig. 1 PRIOR ART
FIGS. 1 through 4 are schematic side sectional views respectively showing constructions of conventional electrical charging devices or corona discharging devices (already referred to)
Figure 2:
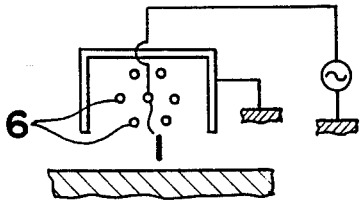
Fig. 2 PRIOR ART
Figure 3:
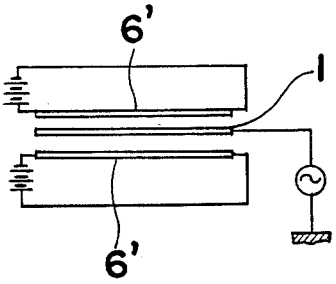
Fig. 3 PRIOR ART
Figure 4:
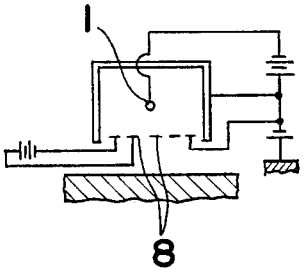
Fig. 4 PRIOR ART

Before the description of the present invention proceeds, it is to be noted that like parts are designated by like reference numerals throughout the accompanying drawings.

Figure 5:
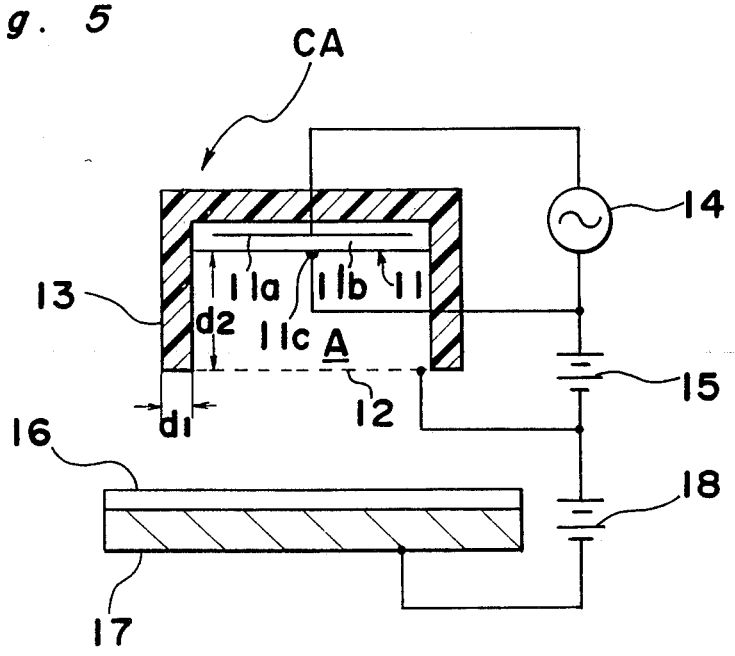
FIG. 5 is a schematic side sectional view showing construction of an electrical charging apparatus according to one preferred embodiment of the present invention.

Referring now to the drawings, there is shown in FIG. 5, an electrical charging apparatus CA according to one preferred embodiment of the present invention.

The electrical charging apparatus CA generally includes a charging panel 11 in which a confronting electrode 11*a* formed by a metallic material such as copper or the like is covered by a heat-resistant electrically insulative member 11*b* made of ceramics, glass, polyimide group resin, etc., with an exciting electrode 11*c* in the form of a thin wire being fixed to an outer surface of said heat-resistant electrically insulative member 11*b*, a control electrode 12 in the form of a mesh, provided adjacent to said charging panel 11, a support member 13 formed by an electrically insulative material to have a generally U-shaped cross-section for covering three sides of said charging panel 11 and also for supporting said control electrode 12, thereby to define a space A therein between said charging panel 11 and said control electrode 12, a high voltage AC power source 14 connected between said confronting electrode 11*a* and said exciting electrode 11*c*, a first DC power source 15 connected between said exciting electrode 11*c* and said control electrode 12, and a second DC power source 18 connected between said control electrode 12 and a backing electrode 17 of an object 16 to be electrically charged.

In the above arrangement, upon impression of a high AC voltage across the confronting electrode 11*a* and the exciting electrode 11*c* by the high voltage AC power source 14, an intensive corona discharge, i.e., surface creeping takes place at a portion where the exciting electrode 11*c* contacts the heat-resistant electrically insulative member 11*b* and also in the vicinity of its surface, and thus, positive and negative ions are produced. These ions are capable of charging the object 16 to any desired polarity and potential according to the bias impression polarities by the first DC power source 15 and the second DC power source 18. By way of example, in the case where the charging object 16 is to be charged to the positive polarity, as shown in FIG. 5, the positive electrode of the first DC power source 15 is connected to the exciting electrode 11*c* and the negative electrode thereof to the control electrode 12, while the positive electrode of the second DC power source 18 is coupled to the control electrode 12 and the negative electrode thereof to the backing electrode 17, thereby to form an electric field directed toward the object 16 to be charged from the exciting electrode 11*c*, and thus, only the positive ion of the positive and negative ions produced in the vicinity of the exciting electrode 11*c* is accelerated in the direction of the object 16 for imparting the charge thereto. It is to be noted that the object 16 is charged up to a potential approximately equivalent to that of the control electrode 12.

Incidentally, the surface creepage or creeping discharge taking place at the charging panel 11 is accompanied by a considerable heat generation, and the above electrical charging apparatus CA has a function to decompose ozone produced during the surface creepage through efficient utilization of the heat thus generated.

More specifically, the control electrode 12 provided adjacent to the charging panel 11 is heated by the heat generation following the surface creepage, and subjects ozone to thermal decomposition within the space A surrounded by the control electrode 12, the charging panel 11 and the support member 13.

Meanwhile, by forming the support member 13 surrounding three sides of the electrical charging apparatus CA with a material superior in heat insulation such as acrylic resin, etc., the space A may be efficiently heated without causing the heat generated by the surface creepage to escape outside. It should be noted here that, in order to heat the space A up to a temperature sufficient for decomposition of ozone, a thickness d1 of the wall of the support member 13 should preferably be set to about 5 mm, and a distance d2 between the charging panel 11 and the control electrode 12, to be in the range of about 1 to 5 mm.

For experiments, through employment of the electrical charging apparatus CA as described so far, when the output of the high voltage AC power source 14 was set to 7.5 KV rms, 10 KHz, that of the first DC power source 15 to 5 KV, that of the second DC power source 18 to 9 KV, the width d1 of the wall of the support member 13 to 2 mm, and the distance d2 between the charging panel 11 and the control electrode 12 to 3 mm, the temperature of the charging panel 11 was raised up to 62° C., and that of the control electrode 12 up to 50° C. In the above case, ozone concentration as measured at the outer side of the control electrode 12 was 0.2 ppm. In connection with the above, ozone concentration measured under the same conditions as above except for the removal of the control electrode, was in the range of 2 to 3 ppm.

As is seen from the above experiments, the ozone generating amount in the above electrical charging apparatus CA could be reduced to less than 1/10 of that in the apparatus not provided with the control electrode 12, and it was confirmed that the above result was generally equivalent to a result obtained when ozone was removed through employment of an ozone filter. It was further ensured that the ozone concentration of 0.2 ppm and the temperature of the control electrode 12 at 50° C. did not substantially adversely affect the photoreceptor at all.

Figure 6:
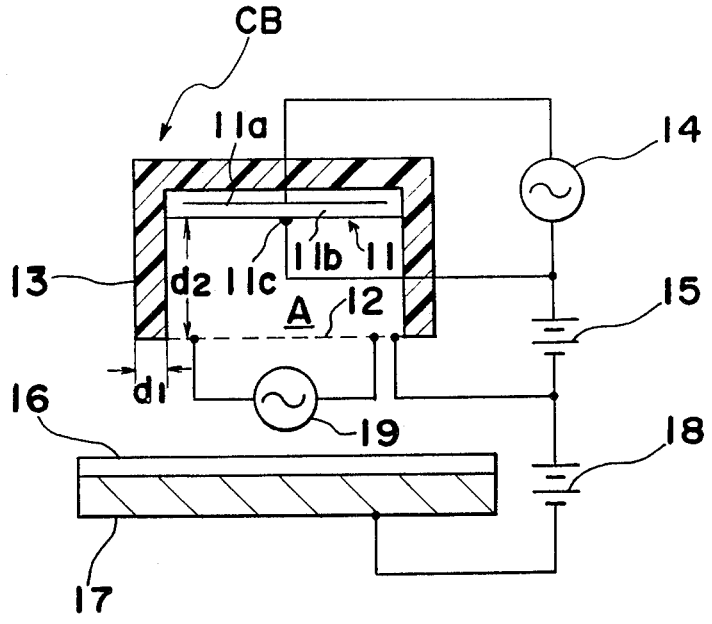
FIG. 6 is a view similar to FIG. 5, which particularly shows a second embodiment thereof.

In an electrical charging apparatus CB in FIG. 6 according to a second embodiment of the present invention, the control electrode 12 is formed by an electric heating member, for example, of a nickel-chrome or nichrome wire and the like, while an AC power source 19 for the electric heating member is further connected to the control electrode 12 as shown. Since other constructions are generally similar to those in the electrical charging apparatus CA of FIG. 5, detailed description thereof is abbreviated here for brevity, with like parts being designated by like reference numerals.

The power source 19 as referred to above is adapted to heat the control electrode 12 by being energized for a predetermined period of time from the starting of the surface creepage. In other words, said power source 19 is intended to auxiliarily heat the control electrode 12 only during a rising time, until said electrode 12 is sufficiently heated by the heat generated following the surface creepage, and thus, ozone produced during the rising of the surface creepage can also be efficiently decomposed.

Figure 7:
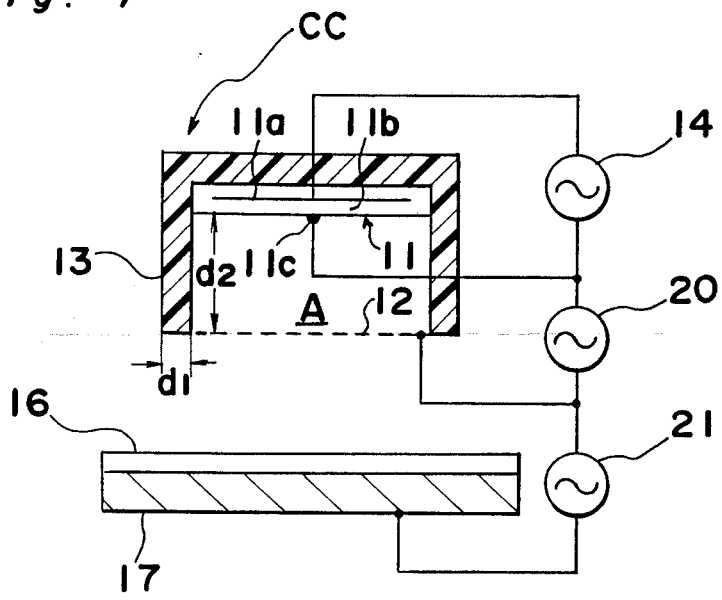
FIG. 7 is also a view similar to FIG. 5, which particularly shows a third embodiment thereof.

Referring further to FIG. 7, there is shown an electrical charging apparatus CC according to a third embodiment of the present invention which is applied to an erasing charger for effecting AC corona discharge. In the charging apparatus CC, the first DC power source 15 and the second DC power source 18 in the charging apparatus CA in FIG. 5 have been respectively replaced by a second AC power source 20 and a third AC power source 21, although other constructions are generally the same as those in FIG. 5, and detailed description thereof is abbreviated here for brevity, with like parts being designated by like reference numerals.

In the arrangement of FIG. 7, the positive and negative ions produced following the surface creepage taking place in the vicinity of the exciting electrode 11*c*, are periodically accelerated in the direction of the control electrode 12 by an alternating electric field formed by the second AC power source 20 between the exciting electrode 11*c* and the control electrode 12, and is further periodically accelerated toward the object 16 to be charged by an alternating electric field formed by the third AC power source 21 between the control electrode 12 and the backing electrode 17. In the manner as described above, the positive and negative ions are imparted onto the object 16 to be charged so as to erase electrical charge on said object 16.

Specifically, the output of the second AC power source 20 should be in the range of 3 to 10 KV rms, 40 to 5000 Hz and more preferably, at 7 KV rms, 400 Hz, while the output of the third AC power source 21 should be in the range of 3 to 10 KV rms, 40 to 5000 Hz, and more preferably, at 5 KV rms, 400 Hz.

Figure 8:
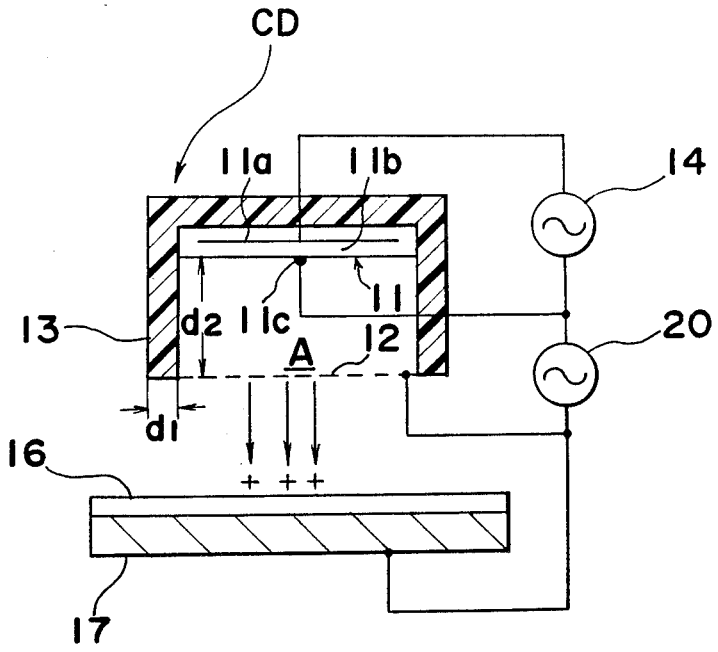
FIG. 8 is a view similar to FIG. 7, which particularly shows a modification thereof.

Reference is further made to FIG. 8 showing a modification of the electrical charging apparatus CC of FIG. 7.

In the modified electrical charging apparatus CD of FIG. 8, the third AC power source 21 in the arrangement of FIG. 7 is omitted so as to maintain the control electrode 12 and the backing electrode 17 at an equal potential, while other constructions are generally the same as those in the arrangement of FIG. 7, and detailed description thereof is abbreviated for brevity, with like parts being designated by like reference numerals.

In the modified charging apparatus CD of FIG. 8, since the control electrode 12 is at the same potential as the backing electrode 17, no electric field is formed between the control electrode 12 and the object 16 in the absence of any electrical charge on said object 16, and therefore, the positive and negative ions produced by the surface creepage are not supplied to said object 16 to be charged.

However, if the object 16 should have any electrical charge even partially, an electric field is formed between the object 16 and the control electrode 12, and the positive or negative ion produced by the surface creepage is imparted to said object 16.

For example, if the charging object 16 has been charged to a positive polarity as illustrated in FIG. 8, the electric field directed from the object 16 towards the control electrode 12 is formed, and by the action of this electric field, only the negative ion of the positive and negative ions produced by the surface creepage is imparted to the object 16 to be charged. When the electrical charge of the object 16 is neutralized by imparting the charge thereto as described above, the electric field between said object 16 and said control electrode 12 disappears, with the imparting of electrical charge being also suspended. In the manner as described above, the electrical charge of the object 16 is erased.

It is needless to say that, in the electrical charging apparatus CC of FIG. 7 and the modified apparatus CD of FIG. 8, ozone is decomposed in the similar manner as in the apparatus CA of FIG. 5 by the action of heat generated by the surface creepage.

As is clear from the foregoing description, since the electrical charging apparatus according to the present invention is arranged to decompose ozone through efficient utilization of heat following the surface creepage, electric power is not particularly consumed for the decomposition of ozone, while, due to the fact that the temperature by the heating is low, there is no possibility that deterioration of a photoreceptor or fusion of toner is caused. Furthermore, if the control electrode is constituted by a heating member so as to be heated only during rising of the surface creepage, it becomes possible to efficiently carry out the ozone decomposition at the rising of the electrical discharge without consuming a large amount of power.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrical charging apparatus which comprises;

a charging panel including a first electrode formed by a metallic plate, a heat-resistant electrically insulative member for covering a surface of said first electrode, and a second electrode in the form of a thin wire fixed to a surface of said heat-resistant electrically insulative member so as to face said first electrode through said heat-resistant electrically insulative member, a power source for applying a high voltage AC current between said first electrode and said second electrode, a third electrode in the form of a mesh provided to confront said second electrode, and a support member for supporting said third electrode and also for surrounding three sides of said charging panel.

2. An electrical charging apparatus as claimed in claim 1, wherein said support member is formed by an electrically insulative heat insulating material.

3. An electrical charging apparatus as claimed in claim 2, wherein said support member is formed into a U-shaped cross section, with a wall thickness thereof being set at about 5 mm, and a distance between said charging panel and said third electrode being set in the range of about 1 to 5 mm.

4. An electrical charging apparatus as claimed in claim 1, further including a first DC power source connected between said second electrode and third electrode, and a second DC power source connected between said third electrode and a backing electrode of an object to be charged.

5. An electrical charging apparatus as claimed in claim 1, wherein said third electrode is provided with a heat generating means for generating heat for a predetermined period of time upon starting of a surface creepage.

6. An electrical charging apparatus as claimed in claim 1, further including a second AC power source connected between said second electrode and said third electrode, and a third AC power source connected between said third electrode and a backing electrode of an object to be charged.

7. An electrical charging apparatus as claimed in claim 1, further including a second AC power source connected between said second electrode and said third electrode, and also connected to a backing electrode of an object to be charged.

* * * * *